US008393499B1

(12) United States Patent
Sholem

(10) Patent No.: US 8,393,499 B1
(45) Date of Patent: Mar. 12, 2013

(54) MULTIPURPOSE DISPENSER ORGANIZER

(76) Inventor: Steven Sholem, Phoenix, AZ (US)

( * ) Notice: Subject to any disclaimer, the term of this patent is extended or adjusted under 35 U.S.C. 154(b) by 506 days.

(21) Appl. No.: 11/940,991

(22) Filed: Nov. 15, 2007

Related U.S. Application Data

(60) Provisional application No. 60/865,967, filed on Nov. 15, 2006.

(51) Int. Cl.
*B67D 7/70* (2010.01)

(52) U.S. Cl. ..... 222/135; 222/93; 222/394; 222/402.1; 222/527

(58) Field of Classification Search ..... 222/135, 222/192, 394, 402.1, 93–94, 526–529, 537
See application file for complete search history.

(56) References Cited

U.S. PATENT DOCUMENTS 3,305,144 A * 2/1967 Beres et al. ..... 222/402.13
4,496,081 A * 1/1985 Farrey ..... 222/135
4,696,414 A * 9/1987 Huat ..... 222/67
5,152,430 A * 10/1992 Ruiberriz de Torres ..... 222/135
5,230,444 A * 7/1993 Dunbar ..... 222/180
5,277,332 A * 1/1994 Rogers ..... 221/96
5,307,964 A * 5/1994 Toth ..... 222/402.13
5,452,825 A * 9/1995 Comstock et al. ..... 222/135
5,487,877 A * 1/1996 Choi ..... 422/300
5,529,226 A * 6/1996 Alberth, Jr. ..... 222/402.1
5,597,093 A * 1/1997 Lee ..... 222/135
5,690,255 A * 11/1997 White ..... 222/135
6,454,133 B1 * 9/2002 Lopez et al. ..... 222/102
6,789,703 B2 * 9/2004 Pierre-Louis ..... 222/101
7,178,693 B1 * 2/2007 Cutrone ..... 222/135
D599,501 S * 9/2009 Dawkins ..... D28/73

* cited by examiner

*Primary Examiner* — Kevin P Shaver
*Assistant Examiner* — Andrew P Bainbridge
(74) *Attorney, Agent, or Firm* — Schmeiser, Olsen & Watts LLP

(57) ABSTRACT

A multipurpose dispenser having a container body adapted to removably retain a plurality of product containers within the container body is disclosed. The dispenser includes a plurality of dispensing devices coupled to the container body. The dispensing devices are adapted for dispensing products from the product containers removably retained within the container body. The dispensing devices include dispensing actuators and nozzles. The dispensing actuators activate dispensing of products through the nozzles for use of the products.

7 Claims, 4 Drawing Sheets

MULTIPURPOSE DISPENSER ORGANIZER

CROSS REFERENCE TO RELATED APPLICATION[S]

This application claims priority to U.S. Provisional Patent Application to Steven Sholem entitled "MULTIPURPOSE DISPENSER ORGANIZER," Ser. No. 60/865,967, filed Nov. 15, 2006, the disclosures of which are hereby incorporated entirely herein by reference.

BACKGROUND OF THE INVENTION

1. Technical Field

This invention relates generally to a dispenser and more particularly to a multipurpose dispenser that dispenses a plurality of products and organizes utensils for use with the plurality of products.

2. State of the Art

There are various products used by consumers that require dispensing from a container holding the product within it. For example, various products commonly used and/or stored in a bathroom require dispensing from a container. These products may include toothpaste, shaving cream, hand lotion, mouthwash, and hand soap. Each of these products has its own container that dispenses the product and allows a person to use the product.

There are limited ways of dispensing and organizing the products within a bathroom or any product in any room. For example, conventional forms of organizing the product containers is by use of a cabinet, a shelving system, organizing on the counter, and use of baskets or other organization structures to retain the product containers. These conventional organization methods have their limitations.

The storing or organizing of the product containers in the conventional forms require separate organizing structures for the product and for the utensils used with that product. The products are often not in a position of easy use and require the use of each individual product container to dispense the product. Further, the conventional forms of organizing product container do not allow for the dispensing of those products.

Additionally, conventional dispensing devices are merely a more decorative container, wherein the product is moved from its current container into the decorative container. This does not allow for a multipurpose dispensing of a plurality of products. Further, the dispensers are adapted for use with only one product type.

Accordingly, there is a need in the field of dispensers for an improved multipurpose dispenser that further provides the ability to organize the product containers and utensils used with the products of the product containers.

DISCLOSURE OF THE INVENTION

The present invention relates to a multipurpose dispenser organizer that dispenses a plurality or products from existing product containers, retains the product containers of the plurality of products and organizes utensils used with the products.

An aspect of the present invention includes a multipurpose dispenser comprising a container body adapted to removably retain a plurality of product containers within the container body. The dispenser further includes a plurality of dispensing devices coupled to the container body. The dispensing devices are adapted for dispensing products from the product containers removably retained within the container body. The dispensing devices include dispensing actuators and nozzles, wherein the dispensing actuators activate dispensing of products through the nozzles for use of the products.

Another aspect of the present invention includes a multipurpose dispenser organizer comprising a container body adapted to removably retain a plurality of product containers within the container body. The dispenser organizer further includes a plurality of dispensing devices coupled to the container body. Additionally, the dispenser organizer comprises a plurality of organization accessories coupled to the container body. The plurality of organization accessories includes at least a cup holder, a tray and a tooth brush holder.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a multipurpose dispenser organizer that dispenses a plurality or products from existing product containers. The dispenser organizer further retains the product containers of the plurality of products and organizes utensils used with the products.

Figure 1:
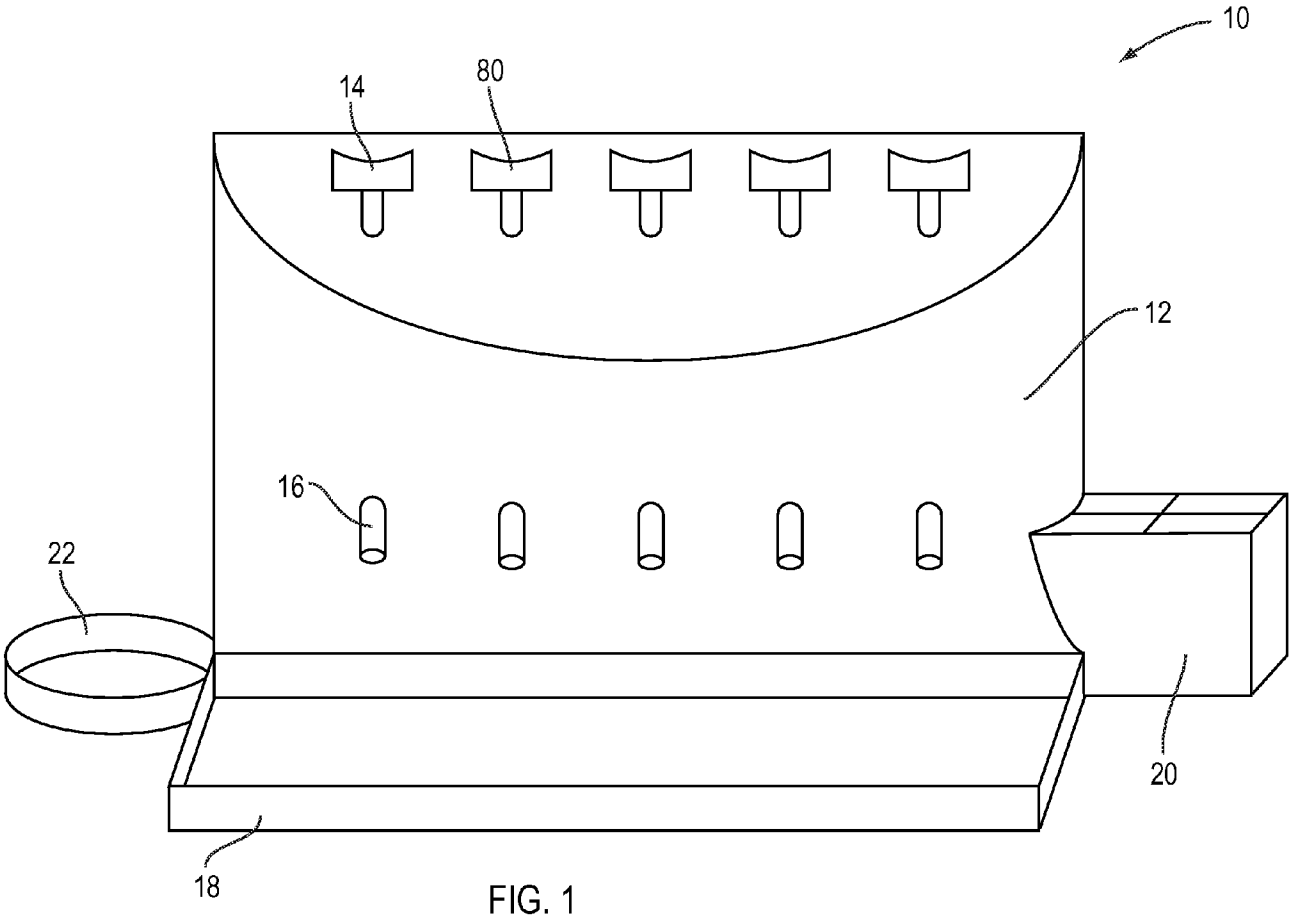
FIG. 1 is a perspective view of a multipurpose dispenser organizer in accordance with the present invention.

Referring to the drawings, FIG. 1 depicts a multipurpose dispenser organizer according to particular embodiments of the present invention. The dispenser organizer 10 comprises a container body 12, a plurality of dispensing actuators 14, 80 of dispensing devices retained within the container body 12, and a plurality of nozzles 16 of the dispensing devices. The container body 12 is adapted to removably retain a plurality of product containers within it. The dispensing actuators 14, 80 allow a user to depress the dispensing actuators 14, 80 to activate dispensing of a product from each of the product containers retained within the container body. While shown with a plurality of dispensing actuators 14, 80, the multipurpose dispenser organizer 10 may include one dispensing actuator. The products are dispensed through nozzles 16. The products may be dispensed onto a user's hand or be dispensed directly onto a utensil. A utensil includes, but is not limited to a tooth brush, a shaving brush, a razor, a comb, a brush, and a cup. The dispenser organizer 10 may be used to dispense products including, but not limited to, tooth paste, shaving cream, liquid soap, lotion and mouthwash. Various dispensing devices may be employed to dispense the various types of products that may be placed within dispenser organizer 10.

Particular embodiments of the present invention may further include organization accessories 18, 20, 22. The organization accessories may include, but are not limited to, a tray 18, a tooth brush holder 20, and a cup holder 22. Further, the organization accessories may also include other types of accessories, such as, but not limited to, a cylindrical container for holding brushes, cotton swabs, cotton balls and other utensils, a tissue holder, a makeup organizer and the like. The organization accessories 18, 20, 22 are each used to organize various utensils or other accessories on the dispenser organizer 10.

Figure 2B:
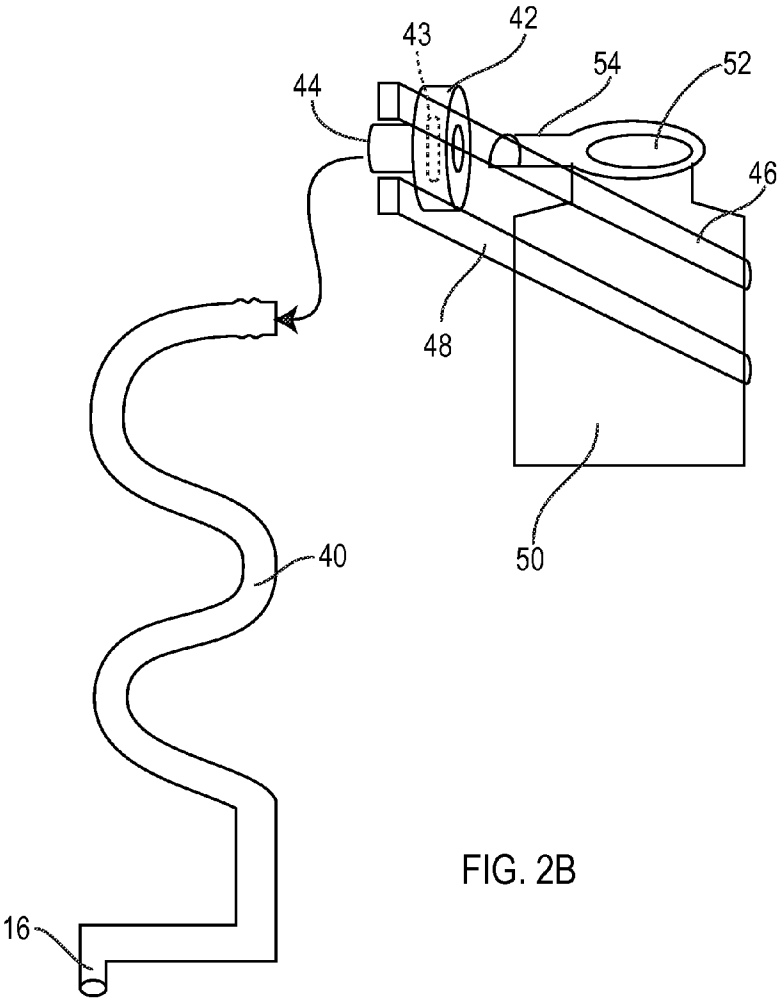
FIG. 2B is a side exploded view of a dispensing device used with a standard shaving cream can in accordance with the present invention.
Figure 2A:
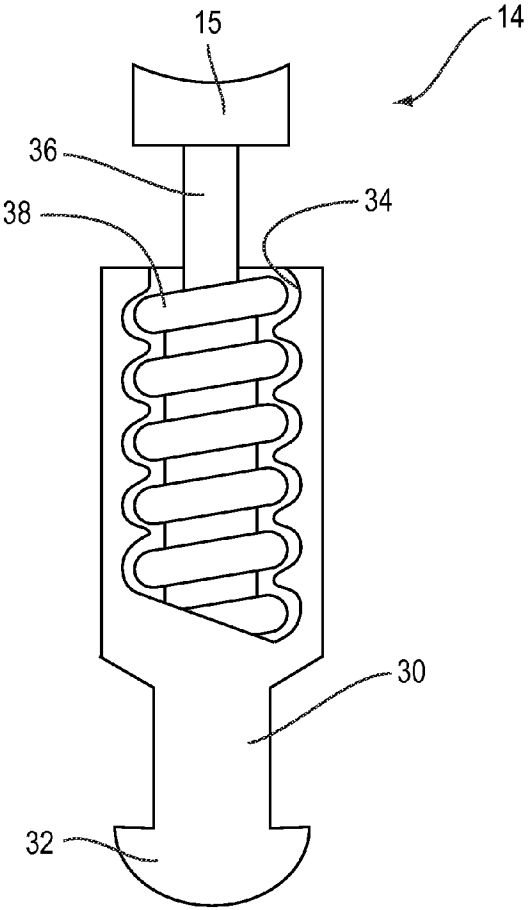
FIG. 2A is a side section view of dispenser actuator for use with a shaving cream can in accordance with the present invention.
Figure 2C:
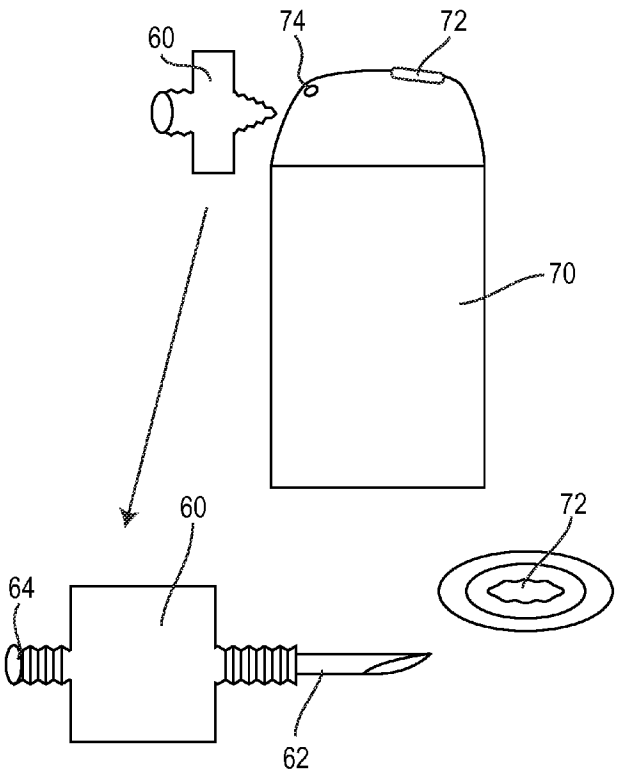
FIG. 2C is a side view of a connector for use with a gel type shaving cream can in accordance with the present invention.

Referring further to the drawings, FIGS. 2A-2C depict a dispensing device for a shaving cream according to embodiments of the present invention. As shown in FIG. 2A, the dispensing actuator 14 may further include a push button 15, a shaft 36, and an adjustable plunger 30 having an engagement end 32 for engaging a shaving cream can 50 or 70 at buttons 52, 72 (See FIGS. 2B and 2C). The plunger 30 is adjustable by use of a threaded coupling between the shaft 36 and the plunger 30. The shaft 36 includes threads 38 that engage corresponding grooves 34 of the plunger 30. The plunger 30 may be rotated in a first direction to extend the plunger 30 away from the push button 15 and rotated in second direction to retract the plunger toward the push button 15. The plunger may be adjusted to adapt to various sized shaving cream cans. It will be understood that various types of adjustable connections may be used between the shaft 36 and the plunger 30, for example, it may be a friction fit, a clamp, a compression cap, and the like.

As shown in FIG. 2B the dispensing device may further include a can adapter 42, flexible tubing 40 and nozzle 16. The can adapter 42 includes a flex silicone washer 43 that engages the nozzle 54 of the shaving cream can 50. The flexible tubing 40 is coupled to the tube connector 44. Upon depression of the button 52 by the dispenser actuator 14, the flex silicone washer 43 of the adapter 42 and silicone tubing 40 allow the shaving cream to travel through the tubing 40 and out the nozzle 16 without expanding until it exits the nozzle 16. Straps 46, 48 are used to retain the adapter 42 in connection with the nozzle 54 of the shaving cream can 50.

As shown in FIG. 2C, another embodiment of the present invention includes can adapter 60 for use with gel type shaving cream can 70. The adapter 60 includes a rigid tube 62 for insertion in the exit hole 74 of the shaving cream can 70. The adapter further includes a tube connector 64 for connecting to the tubing 40. Upon depression of the button 72 by the dispenser actuator 14, the gel type shaving cream product is dispensed through the adapter 60 and tubing 40 and exits through nozzle 16.

Figure 3:
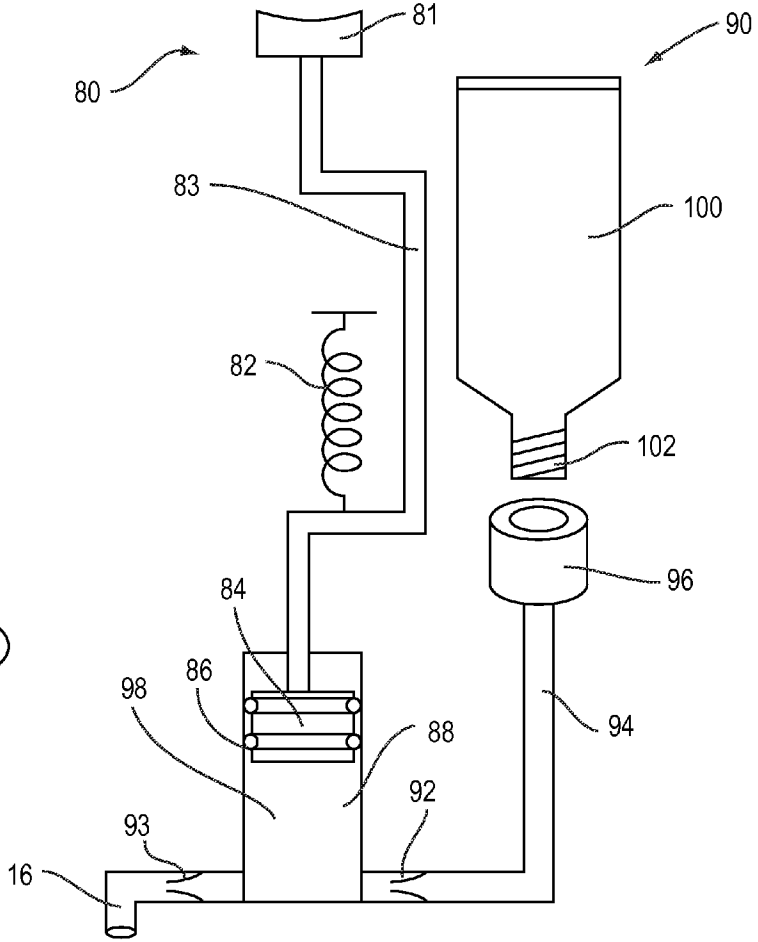
FIG. 3 is diagrammatic view of a dispensing device for use with paste in accordance with the present invention.

Referring again to the drawings, FIG. 3 depicts a dispensing device 90 in accordance with embodiments of the present invention. The dispensing device 90 may be used with a paste tube 100. The dispensing device 90 includes a dispensing actuator 80, a product chamber 88, tubing 94 and a nozzle 16. The dispensing actuator 80 comprises a push button 81 coupled to an upper end of a shaft 83, a spring 82 and a piston 84 coupled to a lower end of the shaft 83. The shaft 83 is configured to engage the spring when the push button 81 is depressed by a user. The spring returns the push button 81 to the position prior to being depressed by the user. The piston 84 is coupled to the shaft 83. The movement of the piston 84 is controlled by the movement of the shaft and the depression of the button 81 by the user. O-rings 86 may be coupled around the piston 84 and engage an inner wall of the product chamber 88. Product chamber may contain inner volume 98 that is adapted to receive and retain a predetermined amount of product.

The paste tube 100 may be connected to the tube adapter 96 at the tube end 102. Once the paste tube 100 is connected, the dispensing device 90 is ready to dispense the paste. The user may be required to prime the dispensing mechanism by repeated depressing and releasing the button 81, this action will draw the tooth paste from the tube of paste 100 through tubing 94. The paste passes through one-way valve 92 and into the inner volume 98 of the product chamber 88. Product is drawn into the chamber as the piston 84 is driven upward. A predetermined amount of paste fills the chamber 88. When the button 81 is depressed again, product travels from the chamber 88 through one-way valve 93 and exits through nozzle 16. When the piston 84 is driven upward again, the piston draws more paste into the chamber 88.

Figure 4:
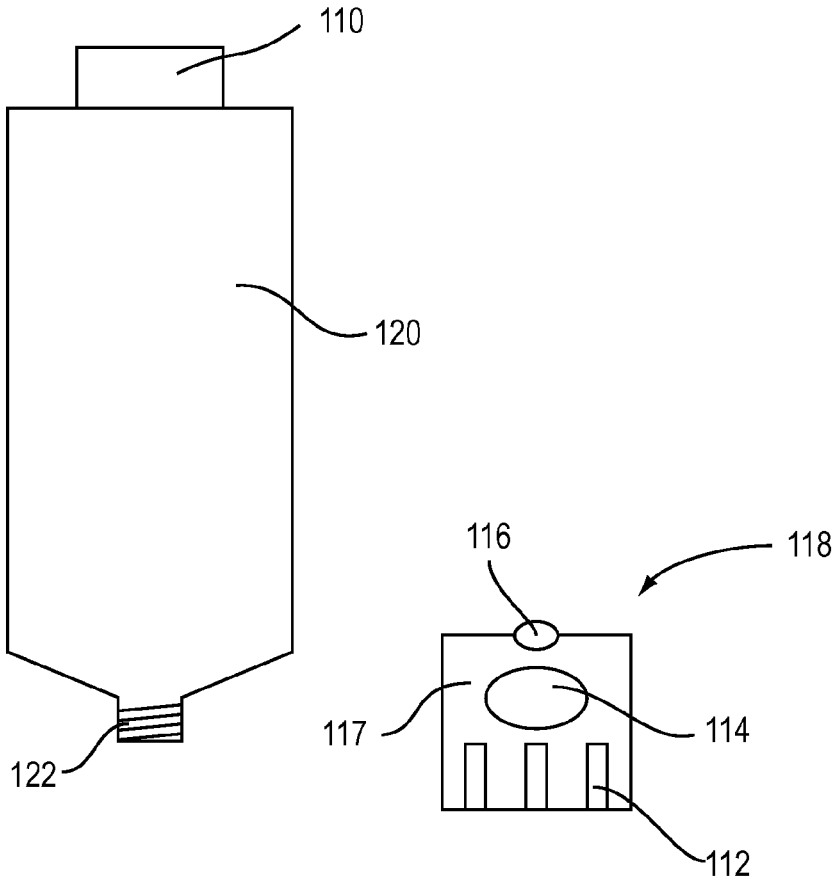
FIG. 4 is a diagrammatic view of a dispensing device for use with hand soap, lotion and mouthwash in accordance with the present invention.

Referring further to the drawings, FIG. 4 depicts a container 120 for use with a dispensing device in accordance with particular embodiments of the present invention. The container 120 has a screw top 110 having vent holes within it. The container 120 has a dispensing end 122. Particular embodiments further include an adapter 118 that may be coupled to the dispensing end 122 at the hole 116. The adapter has an inner volume 117 and a ball 114. As liquid product enters the inner volume 117, the ball floats and engages hole 116, thereby preventing back flow. There may further include a ribbed exit 112 from the adapter 118. The adapter 118 may be coupled to the dispensing device 90, thereby replacing the paste tube 100 with the container 120 and adapter 118. The operation of the piston 84 will draw product from the container 120. In particular embodiments, the ball 114 prevents a product from exiting the container 120 until the container 120 is secured and retained within the dispenser organizer. After the container 120 is secured, the ball 114 allows for gravity and/or suction filling of the chamber 88.

While FIGS. 2A and 3 depict different dispensing actuators 14 and 80 respectively that require a manual depression of a button 15 and 81, other actuators may be employed. For example, and without limitation, the actuators may include a lever, a slide mechanism, a twisting mechanism, and the like.

It will be understood that while particular dispensing devices have been shown in the drawing figures, various dispensing devices may be utilized to address the dispensing of a plurality of products. These various dispensing devices may dispense in various ways, including, but not limited to spring loaded devices, gravity dispensing, suction, piston and chamber and the like. Additionally, while various manual dispensing devices are shown, the dispensing device may also include an electric dispensing device requiring electrical power to initiate dispensing. This may include manually activating the dispensing device by pressing a button, or by activation through motion detection or sight interruption of an infra red device.

Further there may include various ways of coupling the product container to the dispensing devices, such as, but not limited to, a screw in device, and air-tight membrane, a washer and/or o-ring placed over a nozzle and secured to the opening of a product container and other like ways of securing the dispensing device to the product container.

Embodiments of the present invention include a multipurpose dispenser organizer that removably retains product containers within the container body. While particular embodiments show a strap for retaining the product container, other embodiments may include other ways of retaining the product container, such as but not limited to, a clip, a clamp, a hook-and-loop fastener, a screw, a bolt, a slot, a press fit and any other form of retaining a product container within the dispenser organizer.

Particular embodiments of the present invention include a multipurpose dispenser organizer that is adapted to rest on a surface such as a counter top. Other embodiments may include a dispenser organizer that is mountable various vertical surfaces including, but not limited to, a wall, a vanity, a mirror, a shower wall and the like. Further, the present invention may be mounted to the various vertical surfaces by use of adhesives, hook-and-loop fasteners, clips, clamps, screws, bolts, magnets and the like.

The components defining any embodiment of the present invention may be formed of any of many different types of materials or combinations thereof that can readily be formed into shaped objects provided that the components selected are consistent with the intended operation of a multipurpose dispensing organizer. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of the present invention may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A multipurpose dispenser comprising:

a container body adapted to removably retain a plurality of product containers within the container body;

a plurality of dispensing devices coupled to the container body, the dispensing devices being adapted for dispensing products from the product containers;

dispensing actuators separately coupled to the dispensing devices; and nozzles coupled to the dispensing devices, wherein the dispensing actuators activate dispensing of products through the nozzles for use of the products, wherein the plurality of dispensing devices includes at least one shaving cream dispensing device, wherein said shaving cream device is oriented upright, and at least one device other than said shaving cream dispensing device, the shaving cream dispensing device comprising:

a can adapter configured to operatively engage the nozzle of a shaving cream can, wherein the can adapter is coupled on one end to flexible tubing and on an opposing end to the nozzle of the shaving cream can, and wherein the dispensing actuator engages a product dispensing button of the shaving cream can upon being depressed and dispensing shaving cream through the can adapter, tubing and out of the nozzle of the shaving cream can.

2. The dispenser of claim 1, comprising at least one organization accessory, wherein said at least one organization accessory comprises at least one tray.

3. The dispenser of claim 2, wherein the at least one organization accessory further comprises at least one of a tooth brush holder, a cup holder, a cylindrical container, a tissue holder, a makeup organizer and combinations thereof.

4. The dispenser of claim 1, wherein the plurality of dispensing devices includes at least one of a liquid dispensing device, a paste dispensing device and combinations thereof.

5. The dispenser of claim 1, wherein the can adapter of the shaving cream dispenser device comprises a flex silicone washer, wherein the flex silicone washer allows the shaving cream to travel through the tubing without expanding.

6. The dispenser of claim 1, wherein the dispensing actuator of the shaving cream dispenser device comprises a shaft operatively coupled to a plunger by use of a threaded coupling, wherein the plunger is adjustable by use of the threaded coupling in order to engage shaving cream cans of various heights.

7. A multipurpose dispenser comprising:

a container body adapted to removably retain a plurality of product containers within the container body;

a plurality of dispensing devices coupled to the container body, the dispensing devices being adapted for dispensing products from the product containers;

dispensing actuators separately coupled to the dispensing devices; and nozzles coupled to the dispensing devices, wherein the dispensing actuators activate dispensing of products through the nozzles for use of the products, wherein the plurality of dispensing devices includes at least one shaving cream dispensing device, wherein said shaving cream device is oriented upright, and at least one paste dispensing device, the shaving cream dispensing device comprising:

a shaving cream can adapter configured to operatively engage the nozzle of a shaving cream can, wherein the can adapter is coupled on one end to flexible tubing and on an opposing end to the nozzle of the shaving cream can, wherein the dispensing actuator of the shaving cream can engages a product dispensing button of the shaving cream can upon being depressed and dispensing shaving cream through the can adapter, the flexible tubing coupled on one end to the shaving cream can adapter and on the opposing end to the nozzle of the shaving cream can, and out of the nozzle of the shaving cream can; and the paste dispensing device comprising:

a product chamber operatively coupled to the dispensing actuator, wherein the dispensing actuator is moveable between a depressed and released position;

a tube adapter configured to operatively couple to a tube of paste;

flexible tubing operatively coupled between the tube adapter and the product chamber and dispensing the paste from the tube of paste out of the nozzle of the dispensing device.

* * * * *